US008117706B2

(12) United States Patent
Sato

(10) Patent No.: US 8,117,706 B2
(45) Date of Patent: Feb. 21, 2012

(54) MANUAL CLEANING INSTRUMENT

(75) Inventor: Tsutomu Sato, Osaka (JP)

(73) Assignee: Nippon Seal, Co., Ltd., Osaka (JP)

( * ) Notice: Subject to any disclaimer, the term of this patent is extended or adjusted under 35 U.S.C. 154(b) by 312 days.

(21) Appl. No.: 12/397,331

(22) Filed: Mar. 3, 2009

(65) Prior Publication Data

US 2009/0223006 A1 Sep. 10, 2009

(30) Foreign Application Priority Data

Mar. 4, 2008 (JP) ..... 2008-052843

(51) Int. Cl.
*A47L 13/00* (2006.01)
*A47L 25/00* (2006.01)

(52) U.S. Cl. ..... 15/104.001; 15/27; 15/39.5; 15/48; 15/221

(58) Field of Classification Search ..... 15/1.52, 15/4, 23, 52.1, 38, 29.5, 50.2, 50.3, 79.1, 15/88.2, 41.1, 256.51, 257.3, 27, 40, 97.1, 15/98, 221
See application file for complete search history.

(56) References Cited

U.S. PATENT DOCUMENTS

| | | | | | |
|---|---|---|---|---|---|
| 260,257 | A * | 6/1882 | Clark | 15/41.1 |
| 1,236,122 | A * | 8/1917 | Suttle | 15/39.5 |
| 1,402,343 | A * | 1/1922 | Doland | 15/39.5 |
| 1,461,814 | A * | 7/1923 | Aisenstein | 15/39.5 |
| 3,651,529 | A * | 3/1972 | Popeil et al. | 15/4 |
| 3,747,152 | A * | 7/1973 | Tsuruzawa | 15/22.4 |
| 3,842,459 | A * | 10/1974 | Tsuruzawa et al. | 15/48 |
| 4,765,012 | A * | 8/1988 | Ueda | 15/4 |
| 7,721,372 | B2 * | 5/2010 | Knopow et al. | 15/27 |

FOREIGN PATENT DOCUMENTS

| | | | |
|---|---|---|---|
| JP | 11178766 | A * | 7/1999 |
| JP | 2001258644 | A * | 9/2001 |
| JP | 2003-265401 | | 9/2003 |
| JP | 2004-329618 | | 11/2004 |

* cited by examiner

*Primary Examiner* — Joseph J Hail
*Assistant Examiner* — Joel Crandall
(74) *Attorney, Agent, or Firm* — Intellectual Property Law Group LLP

(57) ABSTRACT

To provide a compact manual cleaning instrument with which it is simple to collect and discharge dust, with which it is possible to clean in tight spaces, which is silent, and which is comfortable to use. A dust trapping body 3 is brought into contact with a surface to be cleaned, and the manual cleaning instrument 1 is moved back and forth, whereby dust can be trapped and collected in a dust collection chamber 37. The dust which has been collected can be discharged by opening a lid 28.

4 Claims, 6 Drawing Sheets

MANUAL CLEANING INSTRUMENT

CROSS-REFERENCE TO RELATED APPLICATIONS

This application claims priority under 35 U.S.C. §119 to Japanese Patent Application no. 2008-052843, filed in Japan on Mar. 4, 2008, the entire contents of which are incorporated herein by reference.

BACKGROUND OF THE INVENTION

1. Field of Invention

The present invention relates to a manual cleaning instrument which is suitable for cleaning carpets, tatami (straw floor mats), flooring, sofas, chairs, vehicle compartments, and the like.

2. Prior Art

Cleaning instruments which employ a roll of adhesive tape, such as that disclosed in Japanese Unexamined Patent Application Publication 2003-265401, are widely used as conventional manual cleaning instruments. This cleaning instrument has advantages in terms of being compact and easy to store, and also in terms of ease of use. On the other hand, it is necessary to peel the adhesive tape off one sheet at a time once the dust collection has finished, and dispose of it, and this subsequent operation is a burden for the user. There is a further problem in that the cleaning instrument itself gets rid of detritus other than the dust which has been trapped, and therefore there is an increase in the overall amount of detritus. An additional problem is that most of the exposed face is covered by adhesive tape, and therefore the roll of adhesive tape adheres to surrounding articles when cleaning in tight places, such as under a bed, and the instrument cannot be moved smoothly.

There are also manual cleaning instruments which do not employ adhesive tape, such as that disclosed in Japanese Unexamined Patent Application Publication 2004-329618. This is an instrument which makes it possible to collect fibrous dust which has become entangled on carpets etc. when it is pushed against the floor surface, or the like, and moved back and forth. However, it is necessary to move the instrument back and forth while pressing it from above, and therefore it is difficult to reach into tight spaces such as under a bed. Furthermore, the back and forth movement sometimes produces an unpleasant clattering sound and vibration. It is also necessary to separate upper and lower cases in order to dispose of the dust collected.

SUMMARY OF THE INVENTION

Issues to be Resolved by the Invention

There is therefore a demand for a manual cleaning instrument with which collected dust can be easily disposed of, which enables cleaning in tight spaces, which is silent, and which is comfortable to use, and this is achieved without producing waste such as adhesive tape.

Means of Resolving the Issues

The present invention has been devised in order to resolve the issues outlined above, and an embodiment of the invention disclosed is a manual cleaning instrument furnished with: a base which has an internal space and which is provided with an introduction port for taking in dust by the communication of said internal space with the outside at the lower part, and also provided with a discharge port for discharging dust by the communication of the abovementioned internal space with the outside at the upper part, and moreover in which said discharge port is provided with a lid; a hollow dust trapping body which is held inside the abovementioned internal space of the abovementioned base so as to be able to revolve in a front-to-rear direction, and which is provided with a dust collection opening at the top; and a front dust removal body and a rear dust removal body which are held in the abovementioned base in positions to the front and rear of the abovementioned dust trapping body, and which are constantly urged so that the dust removal faces thereof abut the abovementioned dust trapping body, wherein the abovementioned dust trapping body has an outer peripheral face which is arcuate in cross section with the axis of revolution at the center, and part of said outer peripheral face is exposed from the abovementioned introduction port, and also a protrusion which protrudes radially outward and divides the abovementioned outer peripheral face into two regions, namely a front region and a rear region, is provided in the center of the peripheral length of the abovementioned outer peripheral face; a front dust trapping brush comprising an inclined pile whereof the tip ends are directed toward the front edge of the abovementioned dust collection opening of the abovementioned dust trapping body is provided in the abovementioned front region; a rear dust trapping brush comprising an inclined pile whereof the tip ends are directed toward the rear edge of the abovementioned dust collection opening of the abovementioned dust trapping body is provided in the abovementioned rear region; the abovementioned dust removal faces of each of the abovementioned front dust removal body and the abovementioned rear dust removal body face the abovementioned front region and the abovementioned rear region, respectively; a front dust removal brush comprising an inclined pile whereof the tip ends are directed toward the front edge of the abovementioned dust collection opening of the abovementioned dust trapping body is provided on the abovementioned dust removal face of the abovementioned front dust removal body; a rear dust removal brush comprising an inclined pile whereof the tip ends are directed toward the rear edge of the abovementioned dust collection opening of the abovementioned dust trapping body is provided on the abovementioned dust removal face of the abovementioned rear dust removal body; a handle which extends rearward is provided in the center in the direction of axial revolution of the abovementioned base; and a buffer member with which the edge of the abovementioned dust collection opening of the abovementioned dust trapping body in the direction of revolution comes into contact when the abovementioned dust trapping body has revolved a prescribed angle is provided in the abovementioned base.

According to an embodiment of the invention disclosed, dust can be collected simply by placing the manual cleaning instrument in contact with the surface to be cleaned and moving it back and forth. At this time, the revolution of the dust trapping body is limited by the buffer member, and therefore no unpleasant noise of impact is generated. Furthermore, a user can easily access tight spaces by grasping the handle.

An embodiment of the invention disclosed is a manual cleaning instrument, wherein the front edge of the abovementioned lid is pivotably supported at the front edge of the abovementioned discharge port, and a tongue piece which extends from the rear edge of the abovementioned lid latches onto an engaging part provided on the abovementioned handle.

According to an embodiment of the invention disclosed, dust can be released while the handle is still being gripped so the collected dust can be discharged.

An embodiment of the invention disclosed is a manual cleaning instrument as claimed, wherein provision is further made for a pair of wheels which are held on the abovementioned body so as to be able to revolve in the same direction as the direction of revolution of the abovementioned dust trapping body.

According to an embodiment of the invention disclosed, it is possible to suppress the unpleasant vibration which is produced when the manual cleaning instrument is pulled forward.

Effects of the Invention

According to the present invention, it is possible to provide a manual cleaning instrument with which it is possible to collect dust simply by gripping the handle and moving the manual cleaning instrument back and forth while the dust trapping body is in contact with the surface to be cleaned. At this time, the revolution of the dust trapping body is restricted by the buffer member, and therefore no unpleasant impact noise is produced. Furthermore, it is possible to clean in tight spaces by gripping the handle.

REFERENCE NUMERALS

| | | | |
|---|---|---|---|
| 1 | manual cleaning instrument | 2 | base |
| 21 | introduction port | 22 | discharge port |
| 23 | side wall | 24 | side wall |
| 241 | retaining hole | 25 | bearing |
| 26 | spacer wall | 261 | retaining hole |
| 27 | axle | 271 | recess |
| 28 | lid | 281 | open/close shaft |
| 282 | tongue piece | 283 | latching part |
| 284 | knob | 285 | cylindrical wall |
| 286 | cover | 3 | dust trapping body |
| 31 | dust collection opening | 311 | edge |
| 32 | peripheral wall | 33 | side wall |
| 34 | projection | 35 | protrusion |
| 36a | front dust trapping brush | 36b | rear dust trapping brush |

-continued

| | | | |
|---|---|---|---|
| 37 | dust collection chamber | 4a | front dust removal body |
| 4b | rear dust removal body | 41 | pivot shaft |
| 42 | spring | 43a | front dust removal brush |
| 43b | rear dust removal brush | 5 | wheel |
| 51 | projection | 6 | buffer member |
| 7 | handle | 71 | engaging part |
| 711 | projection | | |

SPECIFIC EMBODIMENTS OF THE PRESENT INVENTION

A description will be given next of modes of embodiment of the present invention, based on the figures. Note that the modes of embodiment described below are preferred modes of embodiment of the present invention, and therefore there are various preferable technical limitations, but the scope of the present invention is not limited to these modes, unless it is particularly stated in the following description that there is a limitation in the present invention.

Mode of Embodiment 1

Figure 1:
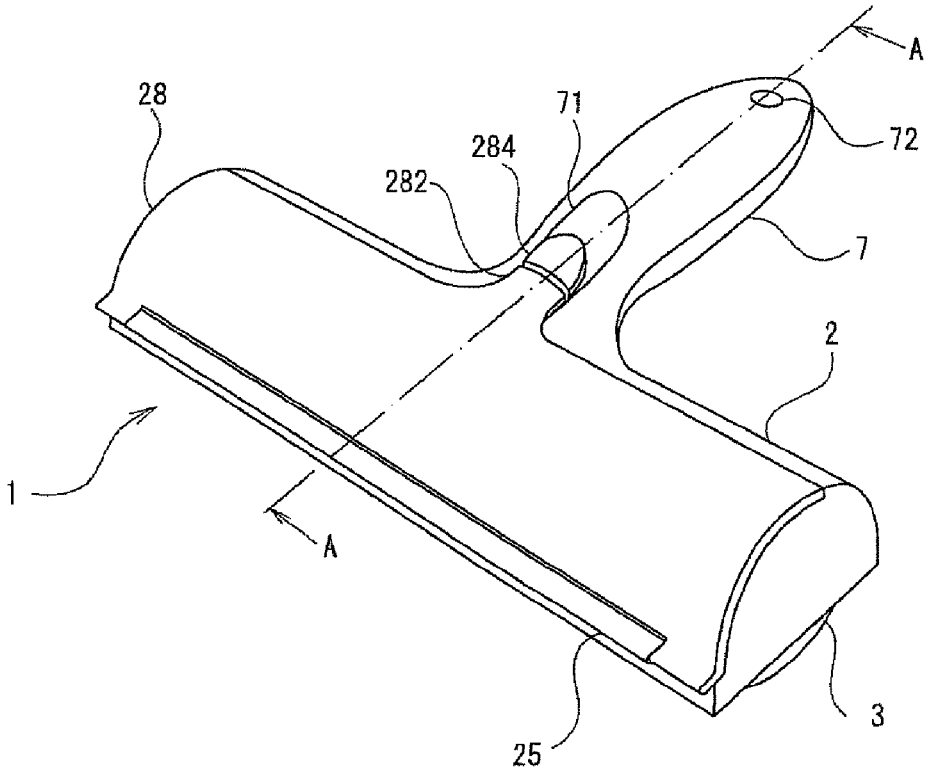
FIG. 1 is an oblique view showing the manual cleaning instrument according to a first embodiment of the present invention.
Figure 2:
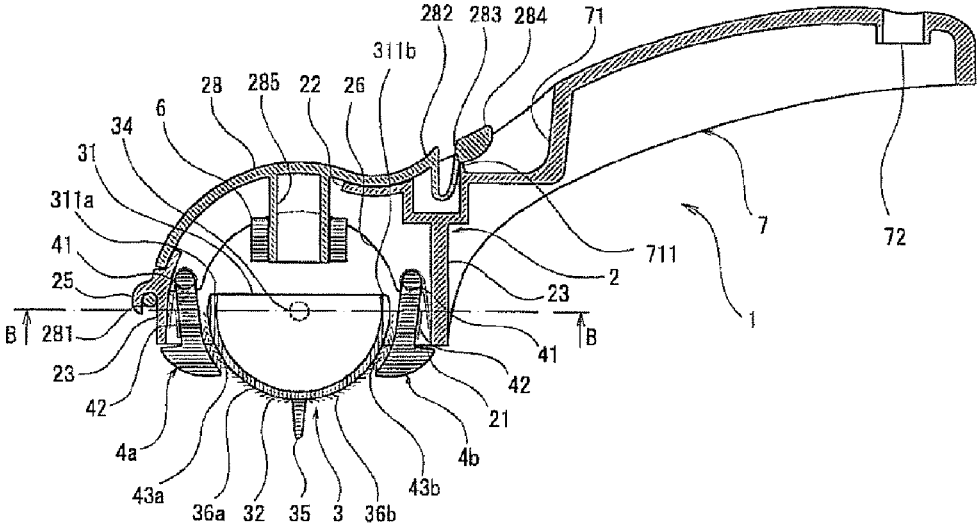
FIG. 2 is a view in transverse section showing the cross section A-A in FIG. 1.
Figure 3:
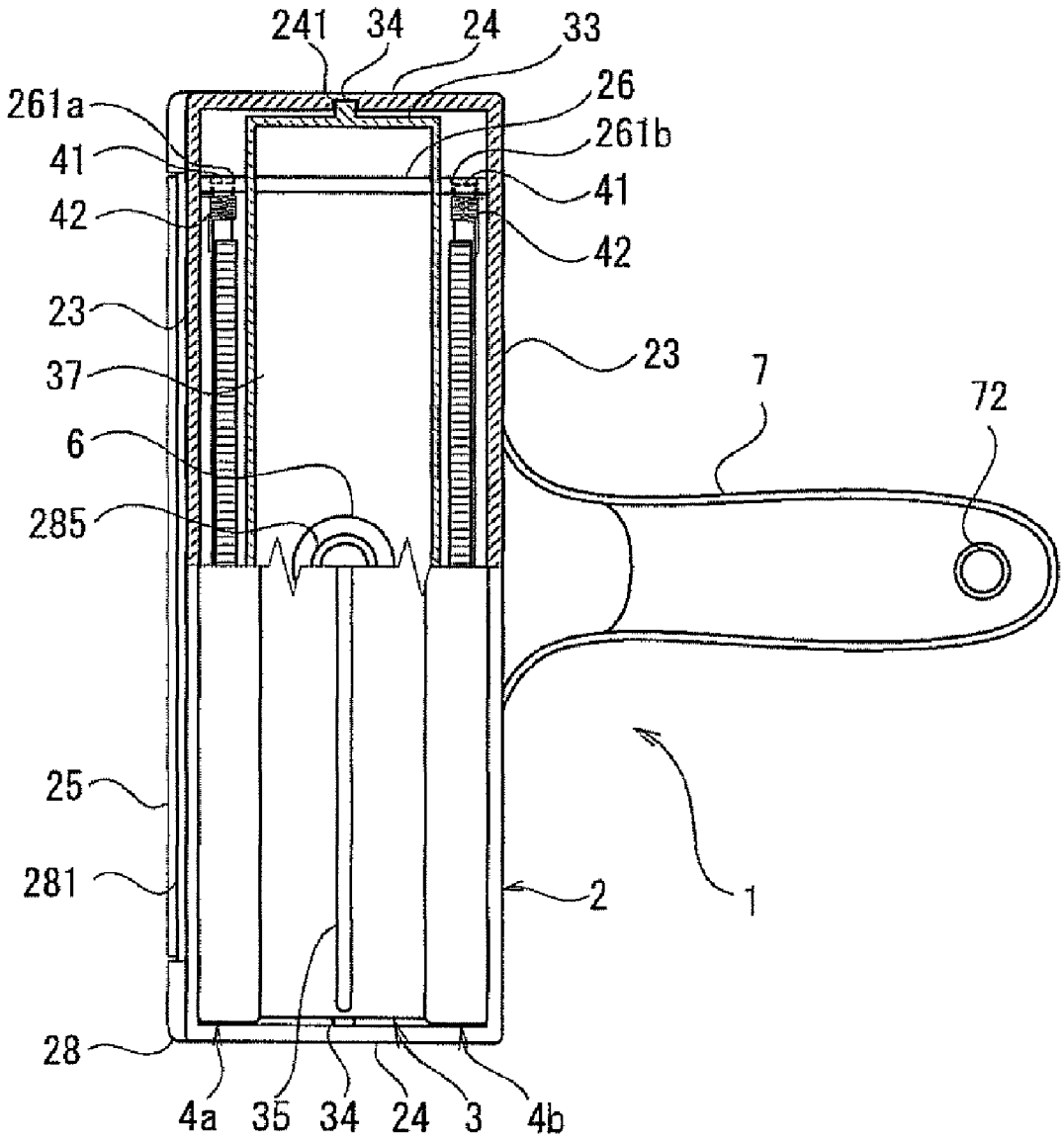
FIG. 3 is a view of the bottom face and a partial view in section showing the cross section B-B in FIG. 2, which shows the manual cleaning instrument according to the first embodiment of the present invention.

The manual cleaning instrument according to Mode of Embodiment 1 of the present invention is shown in FIGS. 1-3. FIG. 1 is an oblique view showing the manual cleaning instrument according to Mode of Embodiment 1, FIG. 2 is a view in transverse section showing the cross section A-A in FIG. 1, and FIG. 3 is a view of the bottom face and a partial view in section showing the cross section B-B in FIG. 2. Note that in the description given hereinafter the left in FIG. 2 to shall refer to the front, and the right shall refer to the rear.

The main structural elements of the manual cleaning instrument 1 according to this mode of embodiment consist of: a base 2 which is prolonged by a handle 7 for the user to grasp; a substantially cylindrical dust trapping body 3 which is pivotably held inside the base 2; and a front dust removal body 4*a* and rear dust removal body 4*b* which abut the dust trapping body 3. "Pivot" in this instance means a turning motion on a single axis through less than 360°. The base 2 and handle 7 may be separate members which are assembled as a single piece, or the handle 7 portion may be produced by bonding separate components, but in this mode of embodiment the base 2 and handle 7 are made of integrally molded plastic.

As shown in FIGS. 2 and 3, the base 2 is provided with side walls 23, 23, 24, 24, and an opening is formed at the upper and lower faces. The opening at the lower face is an introduction port 21 for taking in dust, and the opening at the upper face is a discharge port 22 for discharging collected dust.

A bearing 25 for holding an open/close shaft 281 provided on a lid 28 is formed at the front edge of the discharge port 22 in order to pivotably hold the lid 28.

An engaging part 71 is sunk into the handle 7, and when the discharge port 22 is closed, a tongue piece 282 which projects rearward from the lid 28 is housed therein. A minute projection 711 for latching onto the tongue piece 282 is formed inside the engaging part 71, and this allows latching when the lid 28 is in a closed state.

As shown in FIG. 3, circular retaining holes 241, 241 for pivotably holding the dust trapping body 3 are arranged on the same axis in the central part of the respective left and right side walls 24, 24 of the base 2. In this mode of embodiment, the retaining holes 241 do not pass all the way through, but it is feasible for them to do so. Furthermore, a hanging hole 72 which can be used to hang the manual cleaning instrument 1 from a hook or to pass a thread through is formed passing vertically through the rear part of the handle 7.

The dust trapping body 3 is pivotably held inside the base 2. The dust trapping body 3 comprises a peripheral wall 32 and side walls 33, 33, and it is a hollow, substantially semi-cylindrical member comprising a dust collection opening 31 at the top. In this mode of embodiment, a dust collection chamber 37 is delimited by the peripheral wall 32 and side walls 33, 33 which are integrally molded from plastic. Projections 34, 34 which are formed so as to project from the side walls 33, 33 coaxially with the center of the peripheral wall 32 are inserted into the retaining holes 241 which are provided in the side walls 24 of the base 2 so that the dust trapping body 3 is pivotably held by means of the base 2. In this instance, the dust trapping body 3 is attached to the base 2 in a state in which part of the outer peripheral face is exposed, projecting somewhat further downward than the lower end edge of the introduction port 21.

A protrusion 35 is provided on the outer peripheral face of the dust trapping body 3, projecting radially outward in the center of the peripheral length thereof. The protrusion 35 comes into contact with the surface to be cleaned, and therefore it is preferably made of a soft material so as not to damage the surface to be cleaned, and a material with a large friction coefficient is preferable so as to allow the dust trapping body 3 to rotate by means of the friction with the surface to be cleaned. A rubber material is therefore suitable as the material for the protrusion 35. Furthermore, in this mode of embodiment, one protrusion 35 is provided so as to extend along virtually the whole length of the dust trapping body 3, but it is also feasible to provide a plurality of protrusions which are split in the axial direction.

The outer peripheral face of the dust trapping body 3 is divided into two regions, namely a front region and a rear region with the protrusion 35 as the boundary, a front dust trapping brush 36*a* comprising a short inclined pile whereof the tip ends are directed toward the front edge 311*a* of the dust collection opening 31 being provided in the front region, and a rear dust trapping brush 36*b* comprising a short inclined pile whereof the tip ends are directed toward the rear edge 311*b* of the dust collection opening 31 being provided in the rear region.

The base 2 is provided with a pair of left and right spacer walls 26, 26 which are parallel to the two left and right side walls 24, 24 and whereof the lower part is cut away in a semi-circular shape. A pair of retaining holes 261*a*, 261*a* and a pair of retaining holes 261*b*, 261*b* which are respectively provided on the left and right spacer walls 26, 26 are arranged on the same respective axis, and a front dust removal body 4*a* and rear dust removal body 4*b* (which will be described later) are pivotably held in that place.

As shown in FIG. 2, the front dust removal body 4*a* and rear dust removal body 4*b* are respectively provided between the side walls 23, 23 of the base 2 and the dust trapping body 3. The faces of the front dust removal body 4*a* and rear dust removal body 4*b* which face the dust trapping body 3 are formed as a gentle arc shape. A pivot shaft 41 which projects outward to the left and right is formed at the upper part of the front dust removal body 4*a* and rear dust removal body 4*b*, respectively, and the front dust removal body 4*a* and rear dust removal body 4*b* are able to pivot with the pivot shaft 41 at the center by insertion of said pivot shaft 41 into the retaining hole 261 of the spacer wall 26. A spring 42 is provided around the outside of said pivot shaft 41, and the front dust removal body 4*a* and rear dust removal body 4*b* are urged toward the dust trapping body 3 by means of the spring force of the spring 42. In this mode of embodiment, a torsion spring is used as the spring 42, but a compression spring or a plate spring may be used instead of this. Furthermore, it is also possible to mold the front dust removal body 4*a* and rear dust removal body 4*b* as a single piece with the base 2, without using a separate spring, and the front dust removal body 4*a* and rear dust removal body 4*b* can be urged toward the dust trapping body 3 by being provided extending from the side wall 23.

A front dust removal brush 43*a* comprising a short inclined pile whereof the tip ends are directed toward the front edge 311*a* of the opening 31 of the dust trapping body 3 is provided on the face of the front dust removal body 4*a* which faces the dust trapping body 3, and a rear dust removal brush 43*b* comprising a short inclined pile whereof the tip ends are directed toward the rear edge 311*b* of the opening 31 of the dust trapping body 3 is provided on the face of the rear dust removal body 4*b* which faces the dust trapping body 3. The front dust removal body 4*a* and rear dust removal body 4*b* are constantly urged by means of the spring 42, and therefore the front dust removal brush 43*a* and front dust trapping brush 36*a* are in constant abutment, and the rear dust removal brush 43*b* and rear dust trapping brush 36*b* are in constant abutment.

The lid 28 which is substantially rectangular when seen as a plane is fitted to the discharge port 22 of the base 2 in such a way that in can open and close. The lid 28 in this mode of embodiment comprises the open/close shaft 281 at the front, and it is supported by the bearing 25 provided in the base 2, and therefore it can pivot with the open/close shaft 281 at the center. In addition, the tongue piece 282 projects rearward from the lid 28, and a latching part 283 which forms part of the tongue piece 282 engages with a projection 711 inside the engaging piece 71 which is sunk into the handle 7, whereby the lid 28 can be closed. Furthermore, a knob 284 is formed at the tip end of the tongue piece 282, and pushing the knob 284 upward allows the engagement to be released and the lid 28 to be opened. A configuration can be adopted here in which a torsion spring is provided between the open/close shaft 281 and bearing 25, so that an urging force is constantly imparted to the lid 28, and when the knob 284 is pushed up, the lid 28 opens with force. Moreover, the lid 28 is preferably made from transparent plastic so that it is possible to ascertain the amount of dust which has been collected without having to open the lid 28, but the color and shape of the lid 28 may be appropriately selected.

As shown in FIG. 2, a cylindrical wall 285 projects from the lid 28 toward the dust trapping body 3, and a buffer member 6 made of a soft material and shaped like a doughnut is provided around the outside of the cylindrical wall 285. The buffer member 6 is disposed at a position which is an extension of the peripheral wall 32 of the dust trapping body 3 in the circumferential direction. By means of this, when the dust trapping body 3 pivots through a prescribed angle, the structure can be designed so that the edges 311*a*, and 311*b* of the dust collection opening 31 of the dust trapping body 3 come into contact with the buffer member 6. That is to say, it is possible to prevent impact noise from being produced by contact between the protrusion 35 and the dust removal bodies 4.

Figure 4:
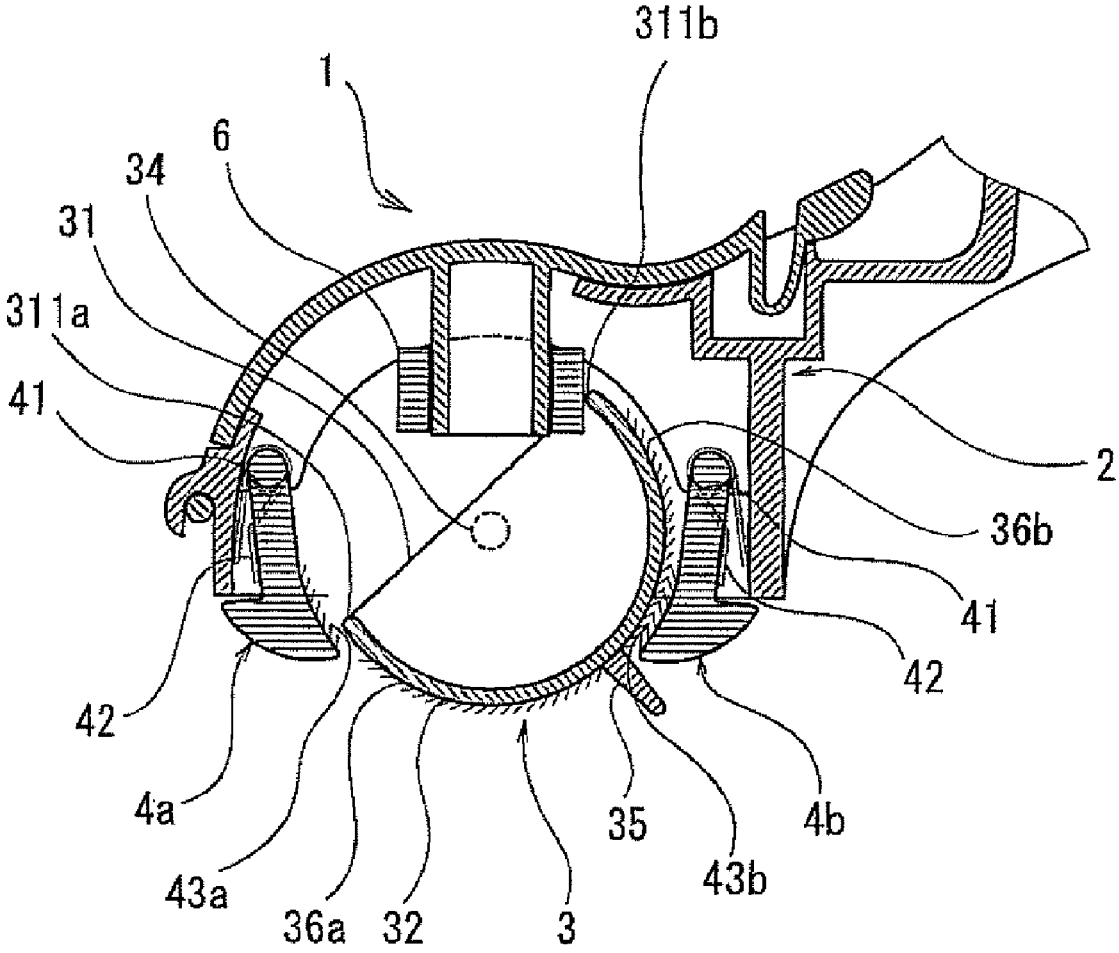
FIG. 4 is a view in cross section showing the state in which the manual cleaning instrument according to the first embodiment of the present invention has been advanced.

A description will be given next of the state of use for the mode of embodiment described above. The handle 7 of the manual cleaning instrument 1 of this mode of embodiment is grasped, the dust trapping body 3 which is exposed from the introduction port 21 is brought into contact with the surface to be cleaned, and the manual cleaning instrument 1 is moved forward. When this is done, the protrusion 35 which projects from the dust trapping body 3 comes into contact with the surface to be cleaned, and is subjected to a rearward friction force, and therefore the dust trapping body 3 rotates in a counter-clockwise direction in FIG. 2 and the edge 311*b* of the dust collection opening 31 comes into contact with the buffer member 6, which stops the rotation. A cross section of the instrument at this time is shown in FIG. 4. Then, if the manual cleaning instrument 1 is moved further forward, dust on the surface to be cleaned is picked up and trapped by the front dust trapping brush 36*a* which is exposed at the bottom from the introduction port 21 of the base 2.

Figure 5:
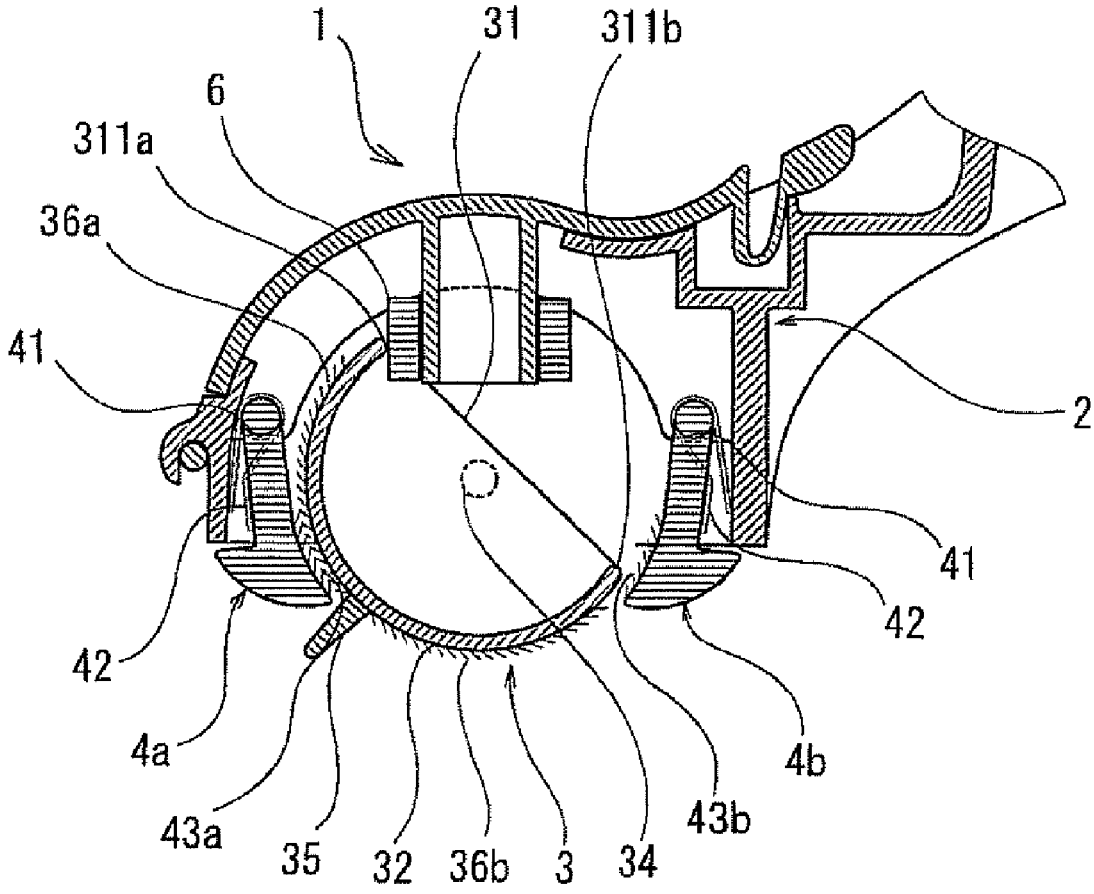
FIG. 5 is a view in cross section showing the state in which the manual cleaning instrument according to the first embodiment of the present invention has been moved back.

Next, when the manual cleaning instrument 1 is moved back, the protrusion 35 which projects from the dust trapping body 3 is subjected to a forward friction force, and therefore the dust trapping body rotates in a clockwise direction in FIG. 2, and the edge 311*a* of the dust collection opening 31 comes into contact with the buffer member 6, which stops the rotation. A cross section of the instrument at this time is shown in FIG. 5. Note that in this state, dust which has been trapped on the front dust trapping brush 36*a* remains adhered to the front dust trapping brush 36*a*. Then, if the manual cleaning instrument 1 is moved further back, dust on the surface to be cleaned is picked up and trapped by the rear dust trapping brush 36*b* which is exposed at the bottom from the introduction port 21 of the base 2.

Next, when the manual cleaning instrument 1 is moved forward once again, the protrusion 35 which projects from the dust trapping body 3 comes into contact with the surface to be cleaned, and is subjected to a rearward friction force, and therefore the dust trapping body 3 starts to rotate in a counter-clockwise direction in FIG. 2. At this time, dust which has adhered to the front dust trapping brush 36*a* is picked up by the front dust removal brush 43*a* which it abuts, and this dust is transferred to the front dust removal brush 43*a*. Then, the edge 311*b* of the opening 31 comes into contact with the buffer member 6, which stops the rotation, and the state shown in FIG. 4 is reached. At this time, dust does not adhere to the front dust trapping brush 36*a* which is exposed at the bottom from the introduction port 21 of the base 2. Then, when the manual cleaning instrument 1 is moved further forward, dust on the surface to be cleaned is picked up and trapped by the front dust trapping brush 36*a* which is exposed at the bottom from the introduction port 21 of the base 2.

Next, when the manual cleaning instrument 1 is moved back once again, the protrusion 35 which projects from the dust trapping body 3 comes into contact with the surface to be cleaned, and is subjected to a forward friction force, and therefore the dust trapping body 3 starts to rotate in a clockwise direction in FIG. 2. At this time, dust which has adhered to the rear dust trapping brush 36*b* is picked up by the rear dust removal brush 43*b* which it abuts, and this dust is transferred to the rear dust removal brush 43*b*.

Meanwhile, dust which has adhered to the front dust removal brush 43*a* is picked up by the front dust trapping brush 36*a* which it abuts, taken up to the edge 311*a* of the opening 31, and stored inside the dust collection chamber 37.

Then the edge 311*a* of the opening 31 comes into contact with the buffer member 6, which stops the rotation, and the state shown in FIG. 5 is reached. At this time, dust does not adhere to the rear dust trapping brush 36*b* which is exposed at the bottom from the introduction port 21 of the base 2. Then, when the manual cleaning instrument 1 is moved further back, dust on the surface to be cleaned is picked up and trapped by the rear dust trapping brush 36*b* which is exposed at the bottom from the introduction port 21 of the base 2.

Next, when the manual cleaning instrument 1 is moved forward once again, the protrusion 35 which projects from the dust trapping body 3 comes into contact with the surface to be cleaned, and is subjected to a rearward friction force, and therefore the dust trapping body 3 starts to rotate in a counter-clockwise direction in FIG. 2. At this time, dust which has adhered to the front dust trapping brush 36*a* is picked up by the dust removal brush 43*a* which it abuts, and this dust is transferred to the dust removal brush 43*a*.

Meanwhile, dust which has adhered to the rear dust removal brush 43*b* is picked up by the rear dust trapping brush 36*b* which it abuts, taken up to the edge 311*b* of the opening 31, and stored inside the dust collection chamber 37.

Then the edge 311*b* of the opening 31 comes into contact with the buffer member 6, which stops the rotation, and the state shown in FIG. 4 is reached. At this time, dust does not adhere to the front dust trapping brush 36*a* which is exposed at the bottom from the introduction port 21 of the base 2. Then, when the manual cleaning instrument 1 is moved further forward, dust on the surface to be cleaned is picked up and trapped by the front dust trapping brush 36*a* which is exposed at the bottom from the introduction port 21 of the base 2.

By repeating the process described above, dust on the floor to be cleaned is collected in the dust collection chamber 37, passing by the front dust trapping brush 36*a* and rear dust trapping brush 36*b*, and the front dust removal brush 43*a* and rear dust removal brush 43*b*. That is to say, the user can remove dust simply by bring the manual cleaning instrument 1 into contact with the surface to be cleaned and moving it back and forth.

Moreover, the dust removal bodies 4 are urged by the spring 42, and it is possible to create a gap between the front dust removal brush 43*a* and rear dust removal brush 43*b*, and the front dust trapping brush 36*a* and rear dust trapping brush 36*b*, and therefore even dust having a large particle size can be smoothly conducted to the dust collection chamber 37. Furthermore, the abutment of the front dust removal brush 43*a* and rear dust removal brush 43*b* with the front dust trapping brush 36*a* and rear dust trapping brush 36*b* is maintained by virtue of constant urging, and therefore dust which has adhered can be reliably picked up between them.

Even if the dust trapping body 3 reaches its maximum relative rotation with respect to the base 2, the position of the buffer member 6 is set so that the opening 31 is not oriented toward the introduction port 21, in other words so that the edges 311 of the opening 31 are not exposed from the introduction port 21. Furthermore, the discharge opening 22 of the base 2 is closed off by the lid 28. Accordingly, there is no risk of dust which has entered the dust collection chamber 37 spilling out during use. Furthermore, the edges 311 come into contact with the buffer member 6 before the protrusion 35 comes into contact with the front dust removal body 4*a* and rear dust removal body 4*b*, and therefore the instrument can be moved back and forth in an agreeable manner, without any unpleasant impact noise being produced by the front dust removal body 4*a* and rear dust removal body 4*b*.

When the user wishes to discharge the dust which has built up, if he operates the knob 284 to release the engagement, the lid 28 pivots about the axis of the open/close shaft 281, and the discharge port 22 is opened, exposing the dust collection chamber 37. It is then possible to remove the dust which has collected in the dust collection chamber 37. Moreover, the knob 284 is housed inside the engaging part 71 of the handle 7, and therefore the user can open the lid 28 with one hand while still grasping the handle 7, and the dust which has collected in the dust collection chamber 37 falls out and is completely discharged by turning the discharge port 22 downward.

Mode of Embodiment 2

Figure 6:
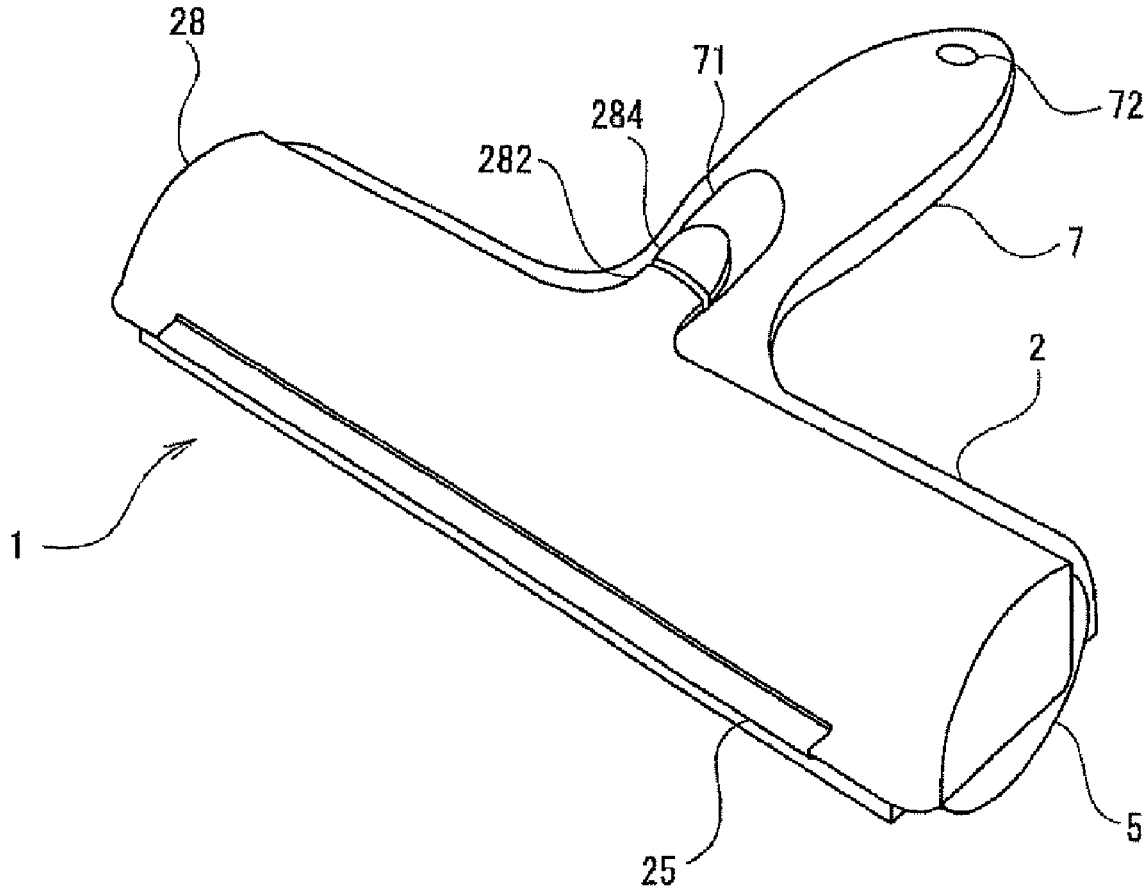
FIG. 6 is an oblique view showing the manual cleaning instrument according to a second embodiment of the present invention.
Figure 7:
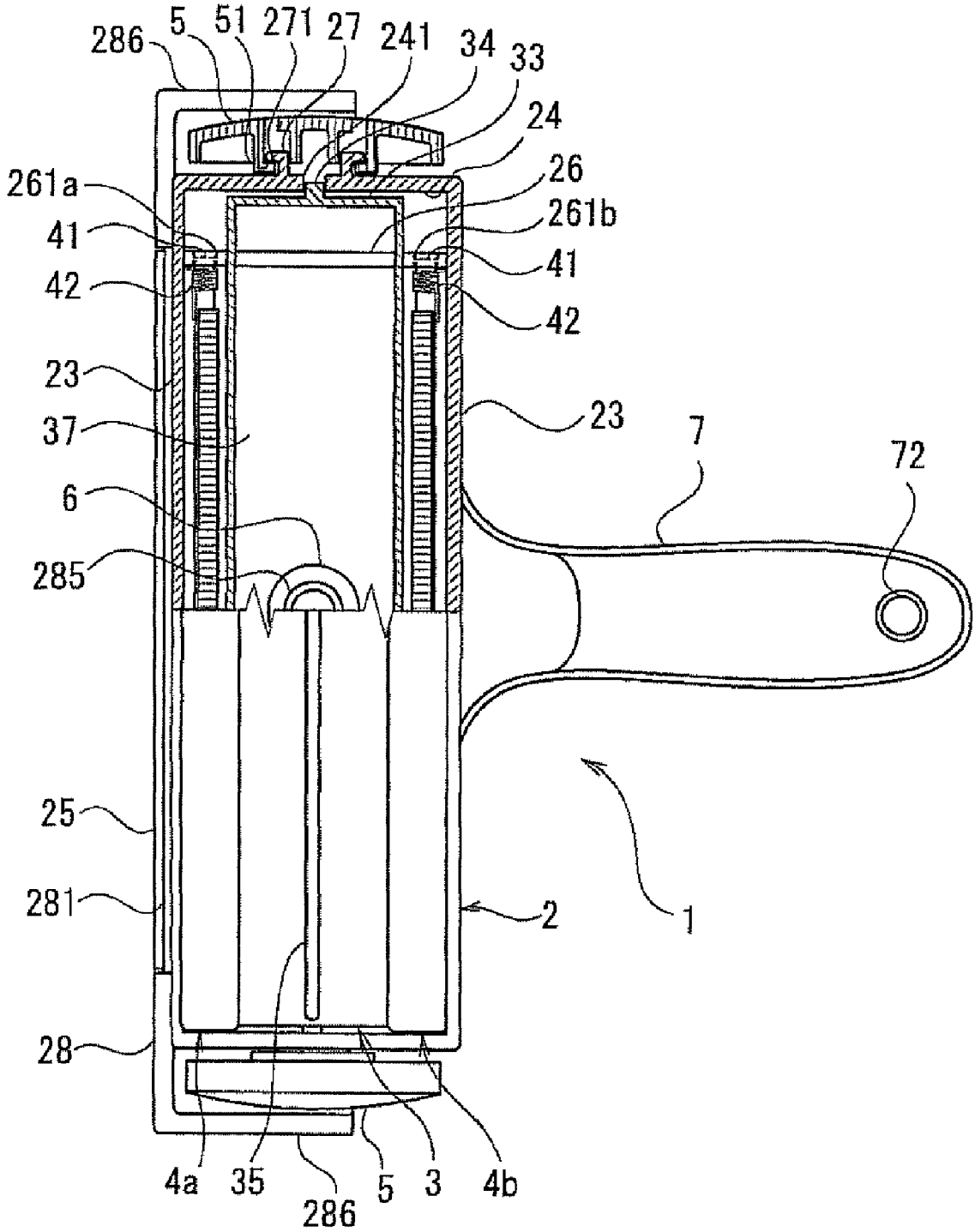
FIG. 7 is a view of the bottom face and a partial view in section showing the manual cleaning instrument according to the second embodiment of the present invention.

A manual cleaning instrument according to Mode of Embodiment 2 of the present invention is shown in FIGS. 6 and 7. FIG. 6 is an oblique view showing the manual cleaning instrument according to Mode of Embodiment 2, and FIG. 7 is a view of the bottom face and a partial view in cross section. The manual cleaning instrument 1 according to this mode of embodiment is an instrument in which detachable wheels 5, 5 are provided at the left- and right-hand ends of the manual cleaning instrument of Mode of Embodiment 1.

An axle 27 is projectingly provided at the side walls 24, coaxially with the retaining holes 241. The wheels 5 can then be rotatably held on the base 2 by the engagement of a projection 51 on the wheel 5 with a recess 271 in the axle 27. "Rotation" in this instance means a turning motion on a single axis through 360° or more. The wheels 5 are made of plastic, and they engage by the elastic force of the material, and therefore the user can remove the wheels himself by releasing the abovementioned engagement.

In addition, the lid 28 is provided with a cover 286 which covers the top part of the wheels 5. By means of this, there is no risk of interference with items around the wheels 5 when the cleaning instrument 1 is introduced into tight spaces etc., and this is preferable for allowing smooth access.

A description will be given next of the action of the wheels 5. As stated in Mode of Embodiment 1, the manual cleaning instrument 1 is moved back and forth to enable trapping of dust on the surface to be cleaned. At this time, the front dust trapping brush 36*a* and rear dust trapping brush 36*b* slide over the surface to be cleaned, but a friction force in the direction of advance and the opposite direction is produced between the surface to be cleaned and the front dust trapping brush 36*a* and rear dust trapping brush 36*b*. Meanwhile, the user grasps the handle 7 and applies a force in the direction of advance in resistance to the friction force. At this time, the point of action of the force exerted by the user is necessarily above the point of action of the friction force, and therefore this offset in the points of action of the force causes a rotation moment to be exerted on the manual cleaning instrument 1.

When the manual cleaning instrument 1 is moved forward, the direction of the rotation moment acting on the manual cleaning instrument 1 is the counter-clockwise direction in FIG. 2. That is to say, it acts in the direction which presses the dust trapping body 3 against the surface to be cleaned. This rotation moment enables contact between the dust trapping brushes 36 and the surface to be cleaned to be strengthened, which enhances the dust trapping effect.

In contrast to this, when the manual cleaning instrument 1 is moved backward, the direction of the rotation moment acting on the manual cleaning instrument 1 is the clockwise direction in FIG. 2. That is to say, it acts in the direction which raises the dust trapping body 3 from the surface to be cleaned. This being so, contact between the front dust trapping brush 36*a* and rear dust trapping brush 36*b* and the surface to be cleaned is weakened, and the magnitude of the friction force may cause the instrument to rise from the surface to be cleaned. In this case, the dust trapping effect is lessened. There is an additional risk of self-induced vibration being generated, whereby the dust trapping body 3 repeatedly jumps from the surface to be cleaned and becomes grounded thereon. The vibration is transmitted to the handle 7, which imparts a disagreeable feeling to the user who is holding it.

If the wheels 5 are provided in this case, it is possible to constantly ensure contact between the manual cleaning instrument 1 and the surface to be cleaned, and a damping effect on the vibration is demonstrated between the wheels 5 and the base 2, making it possible to suppress the generation of self-induced vibration. In addition, even if self-induced vibration is generated, the vibration is transmitted toward the wheels, and it is possible to block disagreeable vibration from being transmitted to the handle 7.

Moreover, the friction force generated varies according to the material from which the surface to be cleaned is made, and it may also be possible to move the instrument smoothly back and forth even without the wheels. Consequently, the wheels 5 are preferably detachably provided at the left and right ends of the base 2 so that the user can attach or detach them as appropriate.

As described above, with the manual cleaning instrument according to the present invention, it is possible to automatically trap dust simply by bringing the instrument into contact with the surface to be cleaned and moving it back and forth, and moreover the dust which has been collected can be easily disposed of.

I claim:

1. A manual cleaning instrument comprising:

a base which has an internal space and which is provided with an introduction port for taking in dust by the communication of said internal space with the outside at the lower part, and also provided with a discharge port for discharging dust by the communication of the internal space with the outside at the upper part, and moreover in which said discharge port is provided with a lid;

a hollow dust trapping body which is held inside the internal space of the base so as to be able to revolve in a front-to-rear direction, and which is provided with a dust collection opening at the top; and a front dust removal body and a rear dust removal body which are held in the base in positions to the front and rear of the dust trapping body, and which are constantly urged so that the dust removal faces thereof abut the dust trapping body, and the dust trapping body has an outer peripheral face which is arcuate in cross section with the axis of revolution at the center, and part of said outer peripheral face is exposed from the introduction port, and also a protrusion which protrudes radially outward and divides the outer peripheral face into two regions, namely a front region and a rear region, is provided in the center of the peripheral length of the outer peripheral face;

a front dust trapping brush comprising an inclined pile whereof the tip ends are directed toward the front edge of the dust collection opening of the dust trapping body is provided in the front region;

a rear dust trapping brush comprising an inclined pile whereof the tip ends are directed toward the rear edge of the dust collection opening of the dust trapping body is provided in the rear region;

the dust removal faces of each of the front dust removal body and the rear dust removal body face the front region and the rear region, respectively;

a front dust removal brush comprising an inclined pile whereof the tip ends are directed toward the front edge of the dust collection opening of the dust trapping body is provided on the dust removal face of the front dust removal body;

a rear dust removal brush comprising an inclined pile whereof the tip ends are directed toward the rear edge of the dust collection opening of the dust trapping body is provided on the dust removal face of the rear dust removal body;

a handle which extends rearward is provided in the center in the direction perpendicular to the axis of revolution of the base; and a buffer member with which the edge of the dust collection opening of the dust trapping body in the direction of revolution comes into contact when the dust trapping body has revolved a prescribed angle is provided in the base, wherein the buffer member provides a means to stop revolution of the dust trapping body and wherein the protrusion is positioned a distance away from the front dust removal body and the rear dust removal body when the buffer member stops the dust trapping body.

2. The manual cleaning instrument as claimed in claim 1, wherein the front edge of the lid is pivotably supported at the front edge of the discharge port, and a tongue piece which extends from the rear edge of the lid latches onto an engaging part provided on the handle.

3. The manual cleaning instrument as claimed in claim 1, wherein provision is further made for a pair of wheels which are held on the base so as to be able to revolve in the same direction as the direction of revolution of the dust trapping body.

4. The manual cleaning instrument as claimed in claim 2, wherein provision is further made for a pair of wheels which are held on the base so as to be able to revolve in the same direction as the direction of revolution of the dust trapping body.

* * * * *